US006161479A

United States Patent [19]

Murray

[11] Patent Number: 6,161,479

[45] Date of Patent: Dec. 19, 2000

[54] PRINTING PLATE FOR A LITHOGRAPHIC ROTARY PRINTING PRESS

[75] Inventor: Robert Richard Murray, Madbury, N.H.

[73] Assignee: Heidelberger Druckmaschinen AG, Heidelberg, Germany

[21] Appl. No.: 09/221,192

[22] Filed: Dec. 23, 1998

[51] Int. Cl.[7] ..... B41N 1/00

[52] U.S. Cl. ..... 101/453; 101/153; 101/375; 101/395; 101/401.1

[58] Field of Search ..... 101/150, 153, 101/368, 375, 395, 401.1, 453, 415.1, 486

[56] References Cited

U.S. PATENT DOCUMENTS 4,157,067 6/1979 Datwyler ..... 101/415.1
4,643,094 2/1987 Holmstrom ..... 101/401.1
4,911,073 3/1990 Sillars ..... 101/375
5,205,039 4/1993 Ternes ..... 101/DIG. 36

*Primary Examiner*—Stephen R. Funk
*Attorney, Agent, or Firm*—Kenyon & Kenyon

[57] ABSTRACT

A lithographic printing plate comprises a plate body with a plurality of predetermined breaking points formed therein. The breaking points extend from a leading end to a trailing end of the printing plate. The predetermined breaking points define edges of sub-plates, each carrying an image which corresponds to a newspaper page of a newspaper to be printed with the lithographic printing plate. The printing plate can be mounted on the plate cylinder of a lithographic rotary printing press as one piece and can afterwards be broken up at the predetermined breaking points, in order to exchange one of the sub-plates against another sub-plate for a new print job, in case of an edition change.

13 Claims, 5 Drawing Sheets

PRINTING PLATE FOR A LITHOGRAPHIC ROTARY PRINTING PRESS

FIELD OF THE INVENTION

The present invention is related to a printing plate for a rotary printing press. In particular, the invention is related to a lithographic printing plate for a web-fed rotary printing press for printing newspapers.

STATE OF THE ART

In a lithographic web-fed rotary printing press, a running paper web is usually fed through a plurality of printing units which apply a single or a multicolor image to the web. When printing commercial magazines or newspapers, it is often desired to change one or more printing plates mounted to the plate cylinders of the press, in order to print the latest news on the front page of a current edition of a newspaper or, if different editions of the same newspaper are distributed in different local areas under different names, to change the title of the newspaper during a production run.

However, in order to initially set up the newspaper press before a new production run, the press operator has to mount a plurality of single printing plates on each of the plate cylinders of the press. In case of a conventional newspaper press, in which usually two, three, four or even more webs are printed in a respective plurality of printing units simultaneously, and each printing unit includes at least two, but usually four or even more plate cylinders, the press operator has to handle a huge number of single printing plates, e.g. up to one hundred, which not only have to be mounted to the right plate cylinder of the printing press in the right sequence and position, but also in the right orientation (head up or head down).

However, also in the prepress field, which is usually related to the layout of the images of the newspaper pages, the transfer of the images of each newspaper page to a respective film and the transfer of the images from the film to the printing plate, each plate is handled independently so that in case of huge newspaper printing presses for printing e.g. a hundred pages and more, huge prepress capacities and facilities and also a considerably huge amount of time for preparing the printing plates in the prepress department have to be provided.

As a result, the time difference between the availability of the final layout of a newspaper and the start of the initial production run is considerably long and can only be shortened by increasing the prepress capacities and the number of press operators for mounting the printing plates on the press. Another possibility is to use automatic plating systems for automatically mounting the printing plates on the respective plate cylinders. However, automatic plating systems are not only expensive, but also have the shortcoming that they require a lot of space which is often not available in printing presses having a compact design.

SUMMARY OF THE INVENTION

Having outlined the state of the art and its attendant disadvantages, it is an object of the present invention to provide for a lithographic printing plate for a rotary printing press, in particular a newspaper press, which helps to reduce prepress capacity and which also helps to reduce the time required for mounting the printing plates on the plate cylinders of a newspaper printing press.

Moreover, it is a further object of the present invention to provide for a method for manufacturing a lithographic printing plate for a newspaper press of the above-indicated type.

The present invention provides a lithographic printing plate for a rotary printing press comprising a plate body and a plurality of predetermined breaking points arranged therein, the breaking points defining edges of sub-plates carrying an image to be printed.

The present invention also provides a method of manufacturing a lithographic printing plate comprising the steps of:

providing a plate body; and applying predetermined breaking points to the plate body, the breaking points defining edges of sub-plates carrying an image to be printed.

The present invention further provides a method of manufacturing a lithographic printing plate comprising the steps of:

providing at least two sub-plates and attaching the sub-plates to each other, so as to form a single lithographic printing plate with predetermined breaking points which can be mounted on a plate cylinder of a lithographic printing press as one piece.

BRIEF DESCRIPTION OF THE DRAWINGS

Other objects and advantages of the present invention will become apparent to those skilled in the art from the following detailed description of preferred embodiments, when read in conjunction with the accompanying drawings wherein like-elements are designated with like-reference numerals and wherein.

DETAILED DESCRIPTION OF THE PREFERRED EMBODIMENTS

Figure 1:
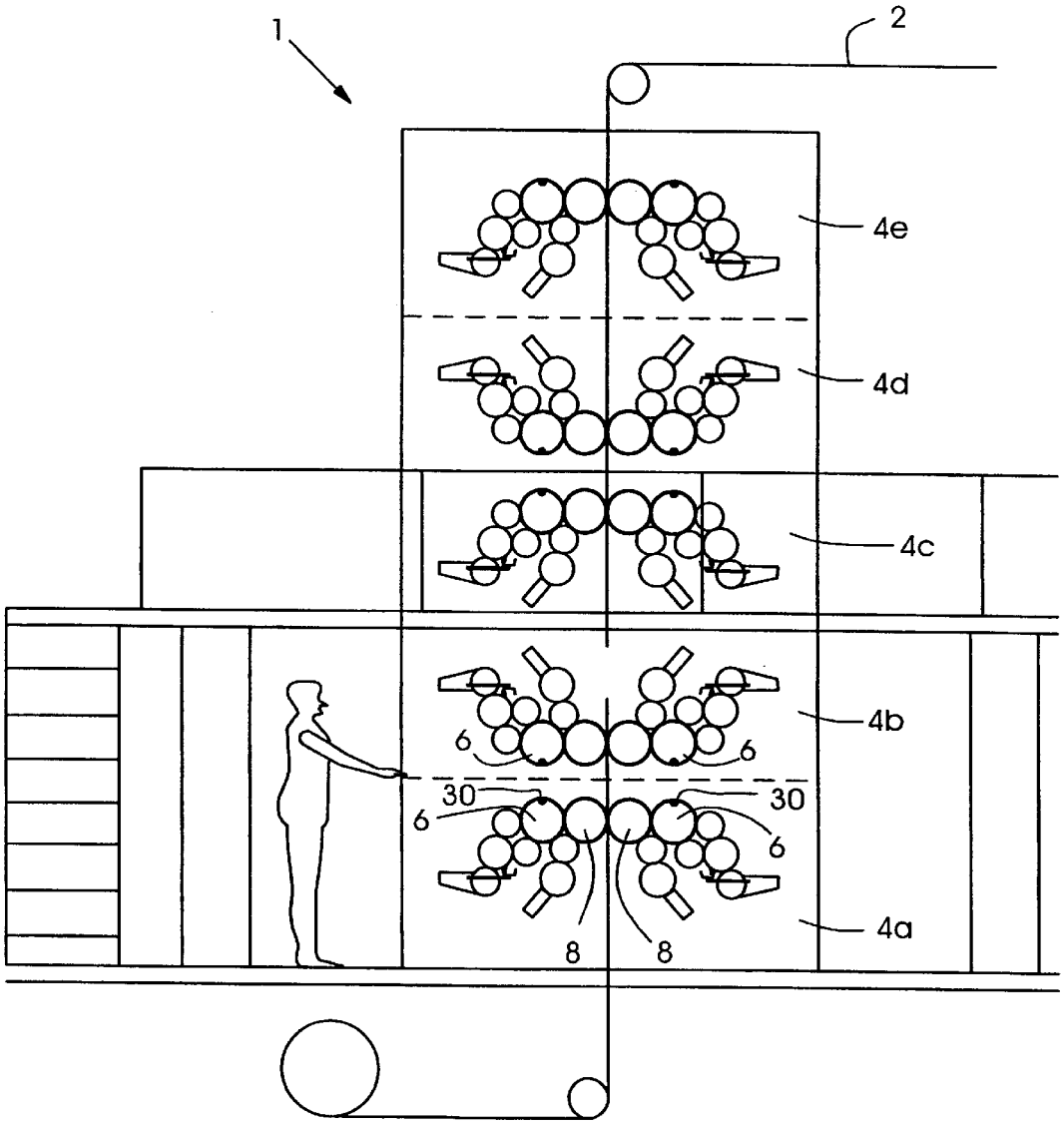
FIG. 1 is a schematic side view of a tower arrangement of blanket-to-blanket printing units for printing on a vertically running web.

As it is shown in FIG. 1, a lithographic rotary printing press 1 comprises a plurality of printing units 4*a*, 4*b*, 4*c*, 4*d* and 4*e* each having one or more plate cylinders 6 and blanket cylinders 8 for printing a single or multicolor image on a running web 2. Although there is only one web 2 shown in FIG. 1, the lithographic rotary printing press may include further printing units for printing a plurality of webs 2, e.g. two, five or eight webs 2, which are not shown in FIG. 1.

Figure 2:
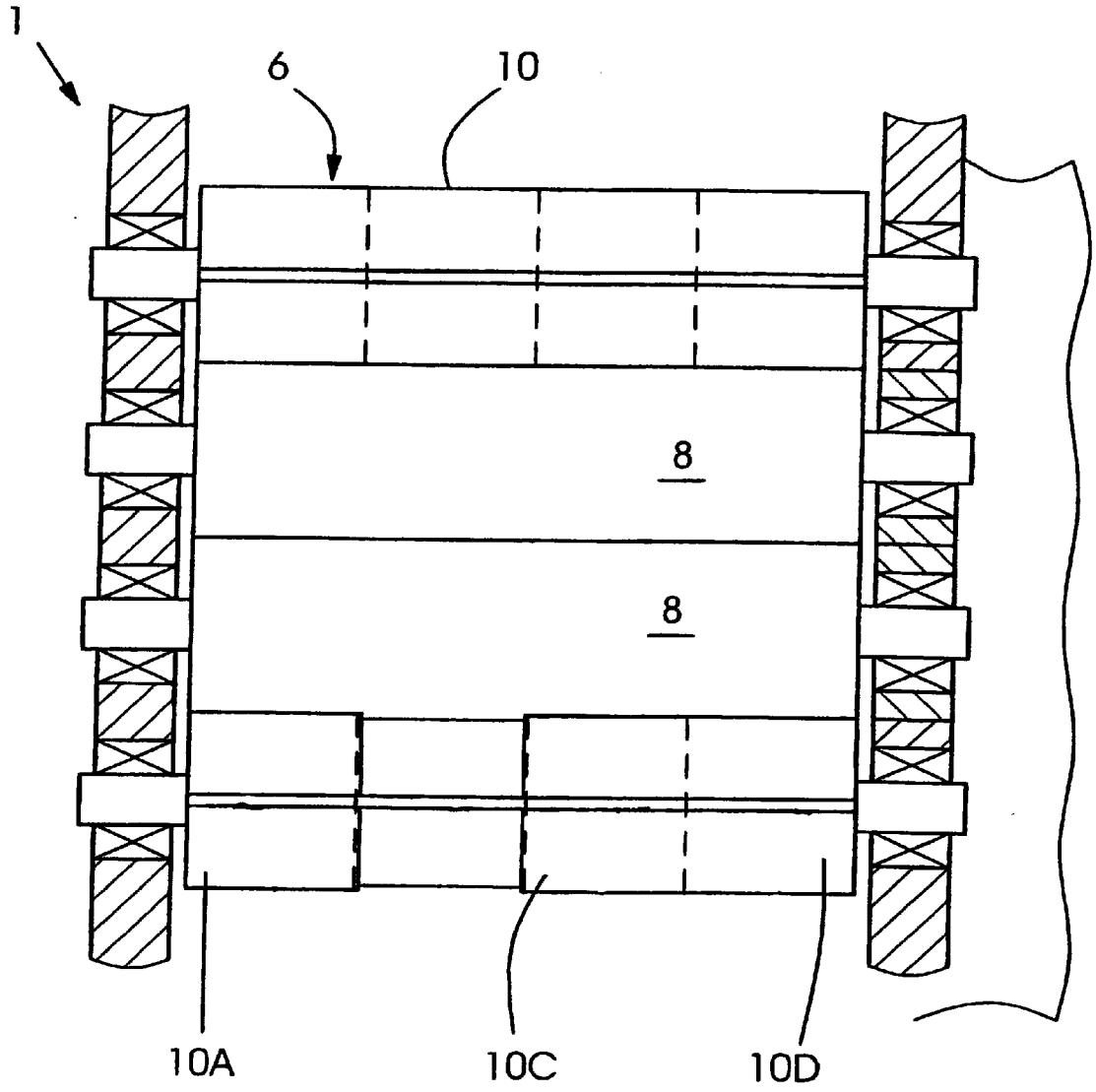
FIG. 2 is a schematic cross sectional view of one of the printing units of the tower arrangement of FIG. 1, having two plate cylinders, each being designed for carrying four sub-plates across, with one of the four sub-plates being taken out to be replaced by a different plate for another edition.
Figure 3:
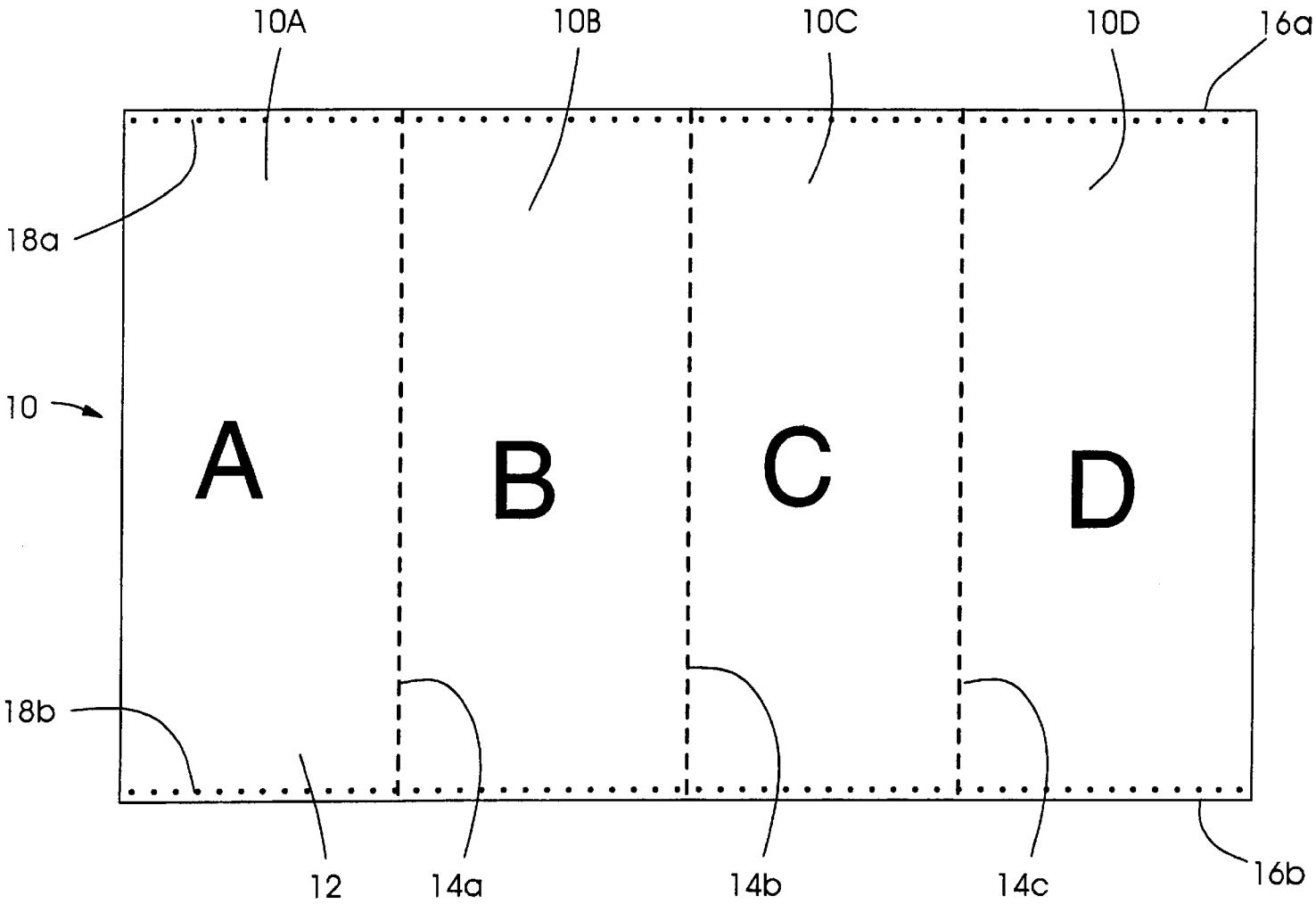
FIG. 3 is a schematic view of a lithographic printing plate according to the present invention, in which the predetermined breaking points which define the edges of the sub-plates A, B, C and D are indicated by dashed-lines.

As it is shown in FIGS. 2 and 3, each plate cylinder 6 is designed to carry one lithographic printing plate 10 according to the present invention which consists of a plurality of sub-plates 10A, 10B, 10C, 10D.

As it is shown in FIG. 3, each lithographic printing plate 10 according to the present invention comprises a plate body 12, which may be a known prior art aluminum plate with a thickness in the range of e.g. 0.2 to 0.5 mm which may be coated with a photo-sensitive layer. The layer may afterwards be imaged with an image corresponding to the image of a respective newspaper page which is indicated by capital letters A, B, C and D.

As it is further indicated by the dashed lines in FIG. 3, each of the printing plates 10 of the present invention comprises one or more predetermined breaking points 14*a*, 14*b*, 14*c* which are formed within the plate body 12 and which define edges of the sub-plates 10A, 10B, 10C and 10D, each carrying the image A, B, C, D of a newspaper page to be printed with the lithographic newspaper press 1.

The predetermined breaking points 14*a*, 14*b*, 14*c* may e.g. extend from a leading edge 16*a* to a trailing edge 16*b* of the printing plate 10.

As it is further indicated in FIG. 3 by dotted lines, the leading edge 16*a* and the trailing edge 16*b* may comprise bent portions 18*a*, 18*b* as they are known from prior art printing plates for mounting the plates onto a plate cylinder. The bent portions 18*a*, 18*b* are preferably applied to the printing plate 10 after imaging the plate, e.g by using a known plate bender.

Figure 4:
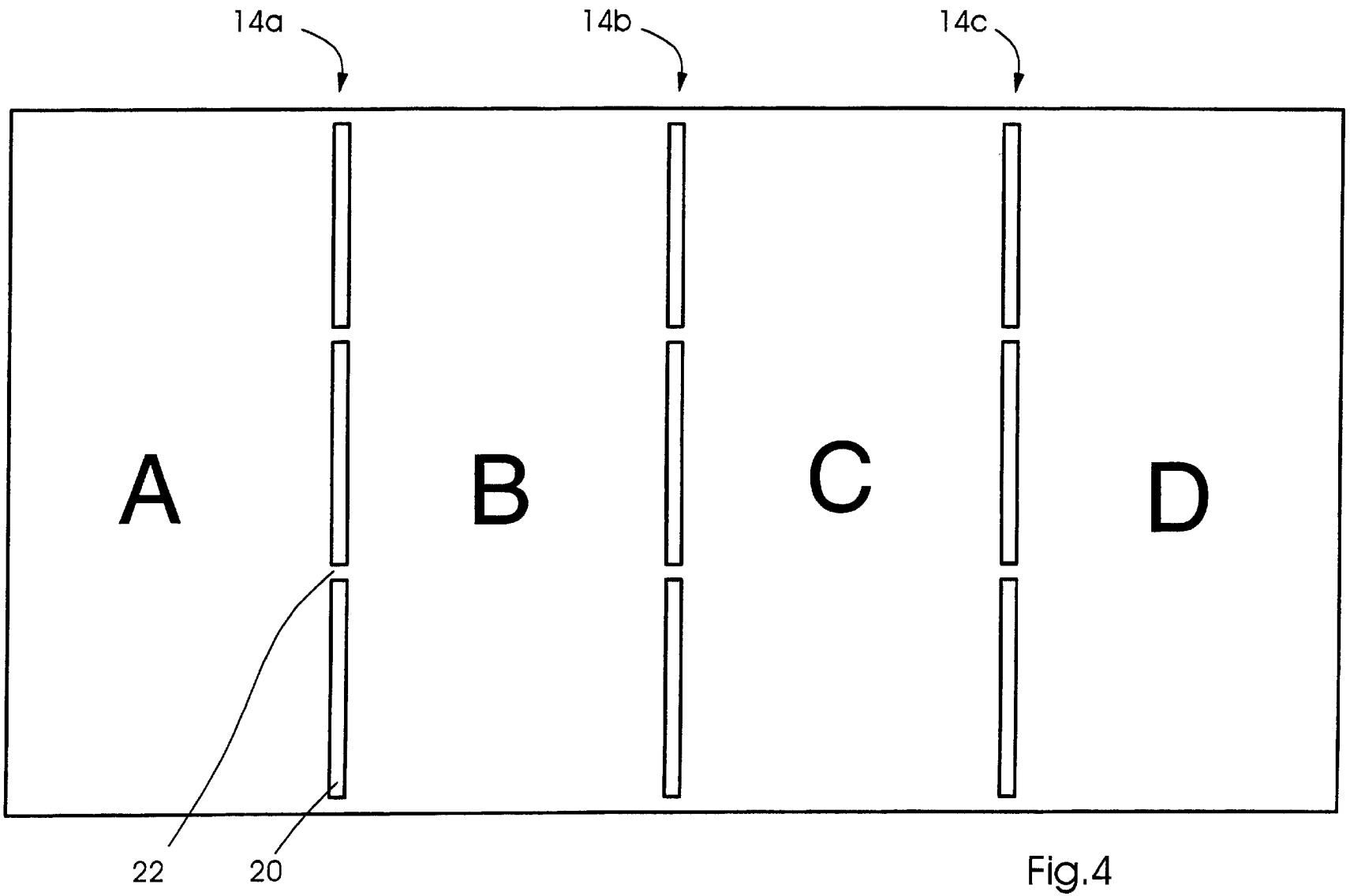
FIG. 4 shows a printing plate according to the present invention, in which the predetermined breaking points are formed as a sequence of longitudinally extending apertures and bridging portions.
Figure 5:
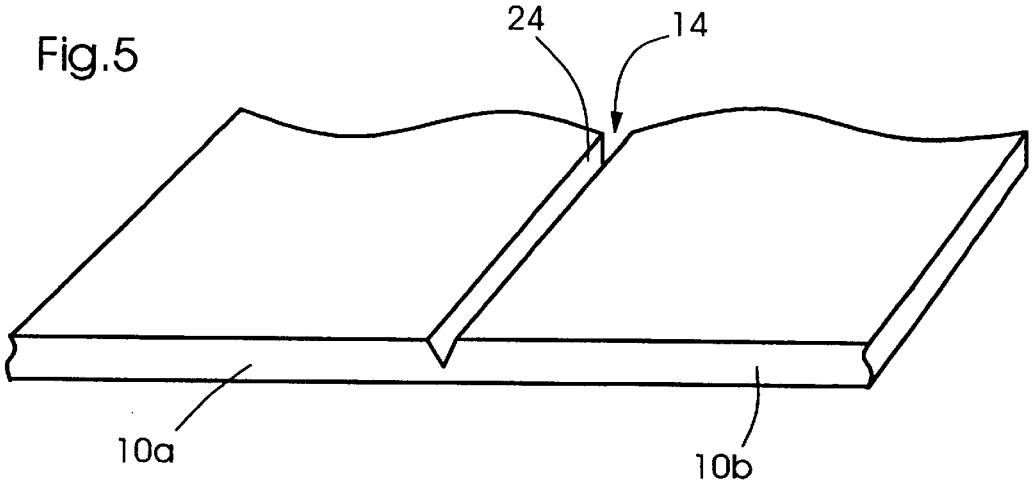
FIG. 5 is an enlarged view of a printing plate according to the present invention, in which the predetermined breaking points are formed as a notch.
Figure 6:
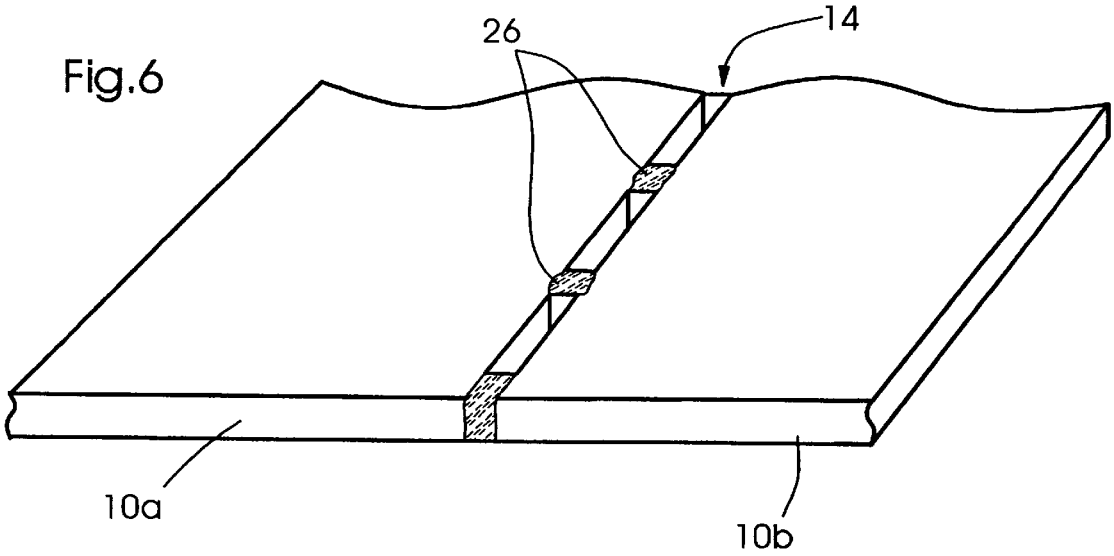
FIG. 6 is an enlarged view of another embodiment of a printing plate according to the invention, in which the predetermined breaking points are formed by a sequence of welding spots
Figure 7:
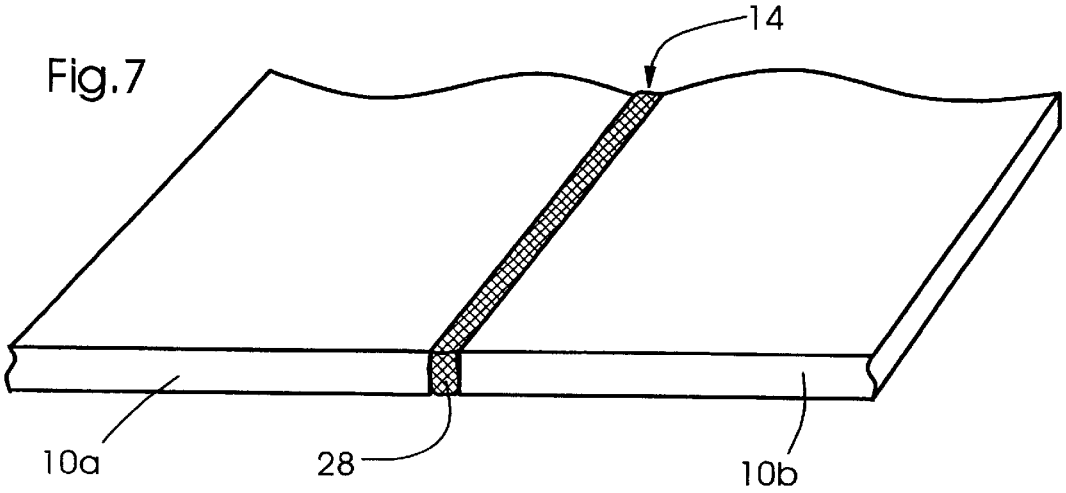
FIG. 7 is an enlarged view of a further embodiment of a printing plate according to the present invention, in which the predetermined breaking points are formed by an adhesive applied to adjoining edges of the sub-plates for connecting the sub-plates.

As it can further be seen from FIGS. 4, 5 and 6, the predetermined breaking points 14*a*, 14*b* and 14*c* may be formed as a sequence of apertures 20 and bridging portions 22 (FIG. 4), or may be formed as a notch 24 (FIG. 5) or a sequence of welding spots 26 (FIG. 6) or any combination of notches 24, welding spots 26 or sequences of holes 20 and bridging portions 22. The apertures or holes 20 may be applied to the printing plate 10 after imaging the plate by using a respectively modified plate bender or plate puncher, when bending the end portions 18*a*, 18*b* of the printing plate or when punching the register holes into the plate.

In the same way, the apertures 20 or the notch or at least notch-shaped groove 24 may also be applied to the plate 10 in another known way, e.g. by using a laser beam, a saw or a drilling apparatus.

According to a further embodiment of the invention, the predetermined breaking points 14 may also be obtained by gluing together two or more sub-plates 10A, 10B, 10C, 10D e.g. by a known glue, adhesive or filler material, as for instance epoxy resin or acrylate, to form a breaking seam 28. Preferably, the gluing together is performed before bending the end portions 18*a*, 18*b* at the leading edge 16*a* or the trailing edge 16*b* of the plate 10.

In the same way, the welding spots 26 of the predetermined breaking points 14 of the embodiment of FIG. 6 are applied to the sub-plates 10A, 10B, 10C and 10D preferably before bending the end portions 18*a*, 18*b* of the sub-plates 14*a*–14*d* by using a known spot welding machine or the like.

Although the predetermined breaking points 14 are preferably applied to the plate body 12 after imaging the plate 10, as it was described herein before with reference to a known plate bender or plate puncher, it is also possible that the predetermined breaking points 14 are already included in the plate body 12, before imaging the printing plate or even before applying the photo-sensitive layer to the plate body 12.

After imaging the entire plate with the respective images A, B, C, and D, the entire plate 10 is mounted to a plate cylinder 6 as one piece, e.g. by using a known plate-lockup mechanism 30, as it is indicated in FIG. 1.

After all of the printing plates 10 according to the present invention have been mounted to the press, the initial production run is started and the press is operated, until the initial production run is completed and a new further run—with for instance a different title page for another local issue of the newspaper—may be started. In this case, the press operator stops the press, removes the respective sub-plate 10A, 10B, 10C or 10D by breaking up the plate 10 at the respective breaking points 14*a*, 14*b*, 14*c* and replaces the removed sub-plate 10A, 10B, 10C and 10D by another sub-plate carrying the new image for another edition of the newspaper.

For breaking up the predetermined breaking points 14 of the printing plate 10 according to the present invention, the press operator may for instance open the lockup mechanism of the respective sub-plate, while the lockup mechanisms of the other subplates which have to remain on the plate cylinder are still locked up. Afterwards, the press operator may manually break up the predetermined breaking points of the respective sub-plate by holding one end portion, e.g. the trailing end portion 16*a*, with his hands and rotating the plate cylinder 6.

As an alternative, the press operator may also use the register adjust mechanism for adjusting the sub-plates 10A, 10B, 10C, 10D, in order to break up the predetermined breaking points 14. This may be achieved by operating the associated register adjustment mechanism in such a way that the register of the sub-plate to be replaced is moved back and forth, until the predetermined breaking points are broken up due to the applied mechanical forces. Afterwards, the sub-plate can be removed, as it is shown for the lower plate-cylinder of FIG. 2.

Although the apparatus and the method according to the present invention have been described with respect to a lithographic newspaper printing press, the invention is not limited thereto and can for instance, also be applied to a flexographic press or in general to a non-offset press or to a sheet-fed rotary printing press.

Moreover, the predetermined breaking points 14 may also be arranged in such a way that the printing plates 10 are broken up horizontally into a plurality of sub-plates 10A, 10B, 10C, 10D, in case that two or more sub-plates are mounted around the circumference of a plate cylinder.

According to another embodiment of the invention, a mechanical cutting device, such as a knife or a cutting blade, may be used to support the breaking up of the single (one-pieced) printing plate into a plurality of sub-plates.

Eventually, in printing presses having a plate cylinder with a sleeve-shaped printing plate mounted thereon, the same procedure may be used by initially providing a single plate sleeve with a set of predetermined breaking points defining the edges of respective sub-plates or sub sleeves, each corresponding to one newspaper page. The plate sleeve is then mounted as one piece onto the plate cylinder, e.g. by axially moving the plate sleeve onto the cantilevered cylinder. After the initial production run of the printing press has been finished the sleeve may be broken up in the same way as set forth above, in order to replace a particular newspaper page by another page, e.g. for another local edition. The new sub-plate may then be mounted to the plate cylinder. The new sub-plate may then be mounted to the plate cylinder.

What is claimed is:

1. A lithographic printing plate for a rotary printing press comprising:

plate body; and a plurality of predetermined breaking points arranged therein, the breaking points defining edges of sub-plates carrying an image to be printed, wherein the breaking points are adapted so that the plate body can be mounted to the printing press in one piece, and after being in operation the breaking points may be controllably detached to form sub-plates which may be removed individually.

2. The printing plate of claim 1, wherein each sub-plate is associated with a newspaper page to be printed by the lithographic printing plate.

3. The printing plate of claim 1, wherein the predetermined breaking points are arranged in lines extending from a leading edge to a trailing edge of the printing plate.

4. The printing plate of claim 1, wherein the predetermined breaking points include continuous grooves.

5. The printing plate of claim 1, wherein the sub-plates are attached to each other by glue and the predetermined breaking points are formed as gluing seams.

6. The printing plate of claim 1, wherein the sub-plates are attached to each other by welding spots and the predetermined breaking points are formed as a sequence of welding spots.

7. A lithographic printing plate for a rotary printing press comprising:

a plate body; and a plurality of predetermined breaking points arranged therein, the breaking points defining edges of sub-plates carrying an image to be printed, wherein the predetermined breaking points include a sequence of holes and are adapted so that the plate body can be mounted to the printing press in one piece, and after being in operation, the breaking points may be controllably detached to form sub-plates which may be removed individually.

8. The printing plate of claim 7, wherein the holes are punch holes.

9. A method of manufacturing and using a lithographic printing plate comprising the steps of:

providing a plate body;

applying predetermined breaking points to the plate body, the breaking points defining edges of sub-plates carrying an image to be printed;

mounting the plate body on a plate cylinder as one piece; and breaking up the plate body at the predetermined breaking points to form sub-plates.

10. The method of claim 9, wherein each sub-plate carries the image of a newspaper page.

11. A method of manufacturing and using a lithographic printing plate comprising the steps of:

providing at least two sub-plates;

attaching the at least two sub-plates to each other, so as to form a single lithographic printing plate with predetermined breaking points which can be mounted on a plate cylinder of a lithographic printing press as one pieces;

mounting the single lithographic printing plate to a plate cylinder; and breaking up the single lithographic printing plate at the predetermined breaking points to form at least two sub-plates.

12. The method of claim 11, wherein the sub-plates are attached to each other by glue.

13. The method of claim 11, wherein the sub-plates are attached to each other by welding spots.

* * * * *